United States Patent [19]

Honma

[11] Patent Number: 4,787,636

[45] Date of Patent: Nov. 29, 1988

[54] GOLF CLUB HEAD

[75] Inventor: Yukihiro Honma, Kawasaki, Japan

[73] Assignee: Kabushiki Kaisha Honma Gorufu Kurabu Seisakusho (Honma Golf Club Mfg., Co., Ltd.), Yokohama, Japan

[21] Appl. No.: 936,873

[22] Filed: Dec. 2, 1986

Related U.S. Application Data

[63] Continuation-in-part of Ser. No. 740,363, Jun. 3, 1985, abandoned.

[30] Foreign Application Priority Data

Feb. 13, 1985 [JP] Japan ..... 60-17746

[51] Int. Cl.[4] ..... A63B 53/04

[52] U.S. Cl. ..... 273/167 R; 273/164; 273/183 D

[58] Field of Search ..... 273/164, 175, 169, 183 D, 273/162 R, 167 R, 167 C, 167 J, 173, 77 A, 77 R; D21/220

[56] References Cited

U.S. PATENT DOCUMENTS

| | | | |
|---|---|---|---|
| D. 186,986 | 1/1960 | Long | D21/220 |
| 3,085,804 | 4/1963 | Pieper | 273/164 |
| 3,486,755 | 12/1969 | Hodge | 273/164 |
| 3,640,324 | 2/1972 | Porter | 273/167 J |
| 4,077,633 | 3/1978 | Studen | 273/164 |
| 4,247,105 | 1/1981 | Jeghers | 273/77 A |
| 4,345,763 | 8/1982 | Swanson | 273/167 J |
| 4,367,877 | 1/1983 | Gibson et al. | 273/164 |
| 4,527,799 | 7/1985 | Solheim | 273/164 |

FOREIGN PATENT DOCUMENTS

| | | | |
|---|---|---|---|
| 266 | 10/1906 | United Kingdom | 273/175 |

*Primary Examiner*—George J. Mario
*Attorney, Agent, or Firm*—Jordan and Hamburg

[57] ABSTRACT

A golf club head includes a body having a front face which is adapted to engage a golf ball, the front face being disposed at an acute angle relative to vertical when a player addresses the ball by viewing the golf club head when the golf club head is in a position to engage the golf ball. The front face has an upper edge portion which is chamfered to form a chamfer face which is disposed at an obtuse angle relative to the front face. The chamfer face has an upper edge which defines the upper boundary of the head body while the front face has a lower edge which defines the lower boundary of the head body. The chamfer face and the front face are disposed such that when a player addresses the ball, the player perceives the plane extending between the upper and lower edges as the ball-engaging plane such that the player thereby perceives the loft angle to be greater than the actual loft angle, the actual loft angle being the acute angle of the front face relative to vertical when a player addresses the ball.

3 Claims, 2 Drawing Sheets

GOLF CLUB HEAD

RELATED APPLICATION

This is a continuation-in-part application of U.S. Ser. No. 740,363 filed June 3, 1985 now abandoned.

BACKGROUND OF THE INVENTION

The present invention relates to an improvement in the construction of a golf club head of the iron type.

Generally average golfers are not as good when using a long iron particularly compared to using a short iron or a middle iron.

This is due to a misperception as a result of using a long iron and results from the effect of perception such as a shown in FIGS. 3 and 4. A width $W_o$ in a hitting direction of a face surface 1*a* of a head body 1 is narrow as indicated by the vision line L at the time of addressing the ball because the loft angle $\theta_o$ decreases as the club number decreases, and therefore the face surface 1*a* appears to be small to produce a feeling of unrest. Consequently, the consciousness and tendency is to hit the ball B high up, that is, there is a strong tendency to take a swing by which a ball is scooped up.

SUMMARY OF THE INVENTION

The present invention alleviates the above-described circumstances, and it is an object of the invention to provide a golf club head which tends to result in a swing which hits the ball more accurately.

In order to achieve the above-described object, the present invention provides an arrangement wherein a chamfer is formed on a tapered surface obtained by rearwardly sloping an upper edge portion on the side of a face surface of a head body.

That is, according to the present invention, since the blade portion of a head body is in the form of a flat or circular tapered surface rearwardly sloped, when a ball is viewed when it is being addressed, the tapered surface of the blade portion is seen as an extended surface of the face surface, whereby the face surface appears to have a continuous integral configuration with the tapered surface of the blade portion. Therefore, the width in a hitting direction of the face surface becomes enlarged to increase the loft angle as far as the senses go. In addition, since the blade portion is formed with a chamfer, the whole weight can be lightened, and the center of gravity may be lowered to enhance the probability to just meet a ball correctly. Moreover, since air resistance at the time of the down-swing is small, it is possible to prevent the head speed from being lowered.

In other words, the present invention has excellent practical effects in that since the aforesaid tapered surface is formed, the face surface and the loft angle are seen to be larger to the senses as viewed at the time of addressing the ball, and therefore the feeling of rest is increased. Consequently, a ball can be hit consciously with a smaller number club than a normal number, for example, a ball can be hit by a long iron with the consciousness of using a middle iron to thereby lower the probability of a misshot as well as providing for using a club of lighter weight and lower center of gravity.

While the present invention has been briefly described, it should be noted that the object and novel features of the present invention will be completely apparent from reading the ensuing detailed description in connection with embodiments shown in the accompanying drawings. However, the accompanying drawings merely illustrate one embodiment for explanation of the present invention and are not intended to limit the scope of the invention.

DESCRIPTION OF THE PREFERRED EMBODIMENT

Figure 1:
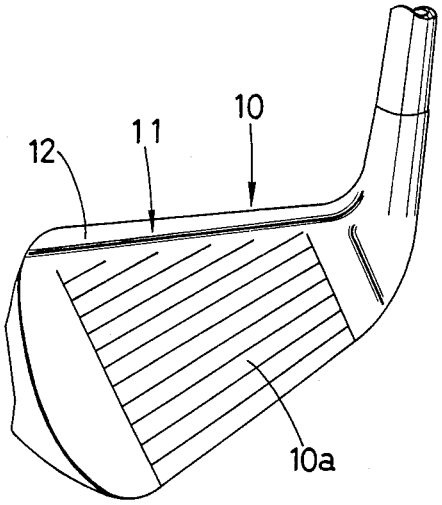
FIG. 1 is a perspective view showing one embodiment of a golf club head in accordance with the present invention.
Figure 2:
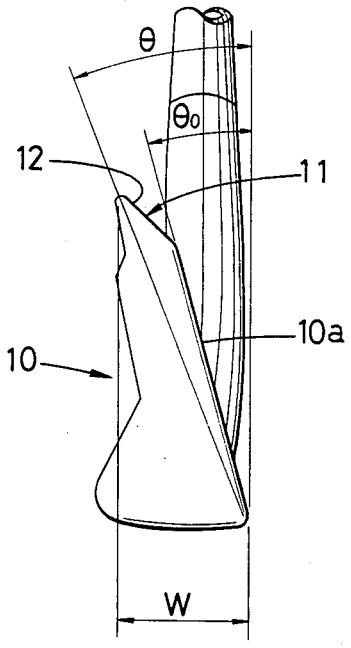
FIG. 2 is a side view of the head as viewed from the toe side.

A golf club head in accordance with the present invention will be described hereinafter by way of one embodiment as shown in FIGS. 1 and 2.

Referring to FIG. 1, reference numeral 10 designates a head body, for example, of an iron club. A blade portion 11 is chamfered at an upper edge portion of the face surface 10*a* of the head body 10 to form a chamfer face 12. The surface 10*a* is in the form of a rearwardly sloping flat surface or circular surface, as shown in FIG. 2, and may be designated as a ball-contacting face since it engages the ball when the club head is swung.

The club includes a heel portion, a toe portion and the upper edge blade portion 11, the vertical extent of the toe portion being greater than the vertical extent of the heel portion, as shown in FIG. 1. However, the chamfered upper edge blade portion 11 is generally uniform in width throughout its length, FIG. 1 showing that the upper edge blade portion 11 is of uniform height or width from the heel portion to the toe portion.

Figure 3:
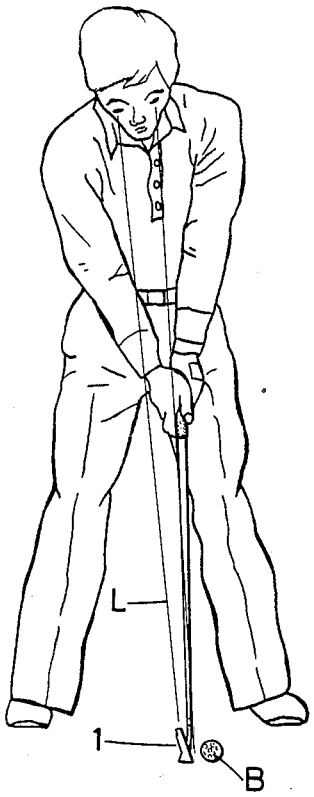
FIG.3 PRIOR ART
FIG. 3 is a explanatory view showing the visual effects at the time of addressing a ball according to the prior art.
Figure 4:
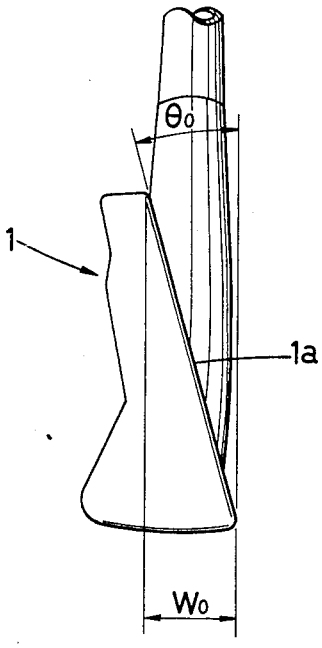
FIG.4 PRIOR ART
FIG. 4 is a side view showing one example of a conventional golf club head.

The head is designed so that the player's vision or perception at the time of addressing the ball, as shown in FIG. 3, is such that the width W of the head in a hittng direction of the face surface 10*a* is perceived to be wider than the conventional construction, that is W is greater than $W_o$ and an imaginary loft angle $\theta$ is perceived to be larger than the actual loft angle $\theta_o$. In FIG. 2, angle $\theta_o$ is the actual loft angle, while $\theta$, which is greater than $\theta_o$, is the perceived loft angle. Thus, the player, looking down at the club when he addresses the ball, as shown in FIG. 3, does not perceive the angle of the front face 10*a* as the loft angle, but perceives the loft angle to be greater so that therefore the player will tend to hit the ball more accurately. In this regard, players have a tendency to select a club having a larger loft angle than might be required or necessary and which could result in an inaccurate shot. Bearing this in mind, the player selects the club based on the perceived loft angle and perceives the loft angle to be $\theta$ (as shown in FIG. 2), wherein in fact, the actual loft is less, that is $\theta_o$ (as shown in FIG. 2). Thus the golf club herein automatically compensates for the player's tendency to select a club having too large a loft angle because he selects the club based on the perceived loft angle which, as previously explained, is greater than the actual loft angle, as will be seen in FIG. 2.

The angle $\theta$ of an imaginary plane extending between the upper and lower edges relative to the axis of the shaft is greater than the angle $\theta_o$ of the plane of the front face 10*a* relative to the axis of the shaft, as shown in FIG. 2. The angle and height of the chamfer face 11 relative to the angle and height of the front face 10*a* is such that when a player addresses the ball, the player perceives the loft angle to be the angle $\theta$ and perceives this to be greater than the angle $\theta_o$ of the front face 10*a* relative to the shaft axis, and less than the angle of the chamfer face 11 relative to the shaft axis. Thus the chamfer face 11 may be designated a sighting face.

It will be noted, of course, that the present invention is not limited to the above-described embodiment but can be applied also to wooden club heads in addition to iron club heads.

While a favorable embodiment of the present invention has been described, it will be apparent that the present invention may be variously modified without departing from the principle thereof. Accordingly, it is desired that all modifications that may substantially obtain the effects of the present invention through the use of the structure substantially identical or corresponding thereto are included in the category of the present invention by the appended claims.

What I claim is:

1. A golf head of the iron type comprising a golf club head attached to a golf club shaft, said golf club shaft having an axis, said golf club head comprising a body, said body having a front face, said front face having a heel portion and a toe portion with the vertical extent of said toe portion being greater than the vertical extent of said heel portion, said front face having an actual ball-contacting face which is adapted to engage a golf ball when the golf club head is swung, said actual ball-contacting face being disposed at an actual acute angle relative to vertical when a player addresses the ball in which the ball-contacting face is in a position to engage the ball, said actual acute angle defining an actual loft angle, said front face having an upper sighting face disposed at an obtuse angle relative to said actual ball-contacting face, an imaginary plane defined by said sighting face extending upwardly and away from said axis of said shaft, said sighting face intersecting said actual ball-contacting face along an elongated intersection, said sighting face being substantially narrower in a generally vertical direction than said actual ball-contacting face and being disposed such that said sighting face does not engage a golf ball when the golf club head is swung, said sighting face extending longitudinally between said heel portion and said toe portion and being generally uniform in width throughout its longitudinal length, said sighting face having an upper edge which defines the upper boundary of the head body, said actual ball-contacting face having a lower edge which defines the lower boundary of the head body, said sighting face and said actual ball-contacting face being disposed to intersect at said obtuse angle at said intersection such that when a player addresses the ball, said front face which includes both said sighting face and said ball-contacting face is perceived by a ball-addressing player as a single continuous surface which is disposed at a perceived acute angle relative to vertical, said perceived acute angle being greater than said actual acute angle, whereby the ball-addressing player perceives a loft angle which is greater than said actual loft angle.

2. A golf head of the iron type comprising a golf club head attached to a golf club shaft, said golf club shaft having an axis, said golf club head comprising a body, said body having a front face, said front face having a heel portion and a toe portion with the vertical extent of said toe portion being greater than the vertical extent of said heel portion, said front face having an actual ball-contacting face which is adapted to engage a golf ball when the golf club head is swung, said actual ball-contacting face being disposed at an actual acute angle relative to vertical when a player addresses the ball in which the ball-contacting face is in a position to engage the ball, said actual acute angle defining an actual loft angle, said front face having an upper sighting face disposed at an obtuse angle relative to said actual ball-contacting face, an imaginary plane defined by said sighting face extending upwardly and away from said axis of said shaft, said sighting face intersecting said actual ball-contacting face along an elongated intersection, said sighting face being substantially narrower in a generally vertical direction than said actual ball-contacting face and being disposed such that said sighting face does not engage a golf ball when the golf club head is swung, said sighting face extending longitudinally between said heel portion and said toe portion and being generally uniform in width throughout its longitudinal length, said sighting face having an upper edge which defines the upper boundary of the head body, said actual ball-contacting face having a lower edge which defines the lower boundary of the head body, said sighting face and said actual ball-contacting face being disposed to intersect at said obtuse angle at said intersection such that when a player addresses the ball, said elongated intersection is imperceptible to the ball-addressing player and said sighting face and said actual ball-contacting face are perceived by the ball-addressing player as a single continuous surface which extends as an imaginary plane between said upper and lower edges and which forms a perceived acute angle relative to vertical, the said perceived acute angle being greater than said actual acute angle, whereby the ball-addressing player perceives the golf club to have a loft angle which is greater than said actual loft angle.

3. A golf head of the iron type comprising a golf club head attached to a golf club shaft, said golf club shaft having an axis, said golf club head comprising a body, said body having a front face, said front face having a heel portion and a toe portion with the vertical extent of said toe portion being greater than the vertical extent of said heel portion, said front face having an actual ball-contacting face which is adapted to engage a golf ball when the golf club head is swung, said actual ball-contacting face being disposed at an actual acute angle relative to vertical when a player addresses the ball in which the ball-contacting face is in a position to engage the ball, said actual acute angle defining an actual loft angle, said front face having an upper sighting face disposed at an obtuse angle relative to said actual ball-contacting face, an imaginary plane defined by said sighting face extending upwardly and away from said axis of said shaft, said sighting face intersecting said actual ball-contacting face along an elongated intersection, said sighting face being substantially narrower in a generally vertical direction than said actual ball-contacting face and being disposed such that said sighting face does not engage a golf ball when the golf club head is swung, said sighting face extending longitudinally between said heel portion and said toe portion and being generally uniform in width throughout its longitudinal length, said sighting face having an upper edge which defines the upper boundary of the head body, said actual ball-contacting face having a lower edge which defines the lower boundary of the head body, said sighting face and said actual ball-contacting face being disposed to intersect at said obtuse angle at said intersection such that when a player addresses the ball, said elongated intersection is imperceptible to the ball-addressing player and said sighting face and said actual ball-contacting face are perceived by the ball-addressing player as one continuous and uninterrupted face, said perceived continuous and uninterrupted face being defined by an imaginary plane extending between said upper and lower edges, said continuous and uninterrupted face being perceived by the ball-addressing player to be at a perceived acute angle relative to vertical which is greater than said actual acute angle, said perceived acute angle being perceived by the ball-addressing player as the loft angle and thereby defining a perceived loft angle, whereby the ball-addressing player perceives the golf club to have a perceived loft angle which is greater than said actual loft angle.

* * * * *